United States Patent [19]

Schneeberger

[11] Patent Number: 4,734,833

[45] Date of Patent: Mar. 29, 1988

[54] WIND LANTERN

[76] Inventor: Peter Schneeberger, Etzmattenstr. 40, D-7800 Freiburg-Tiengen, Fed. Rep. of Germany

[21] Appl. No.: 917,732

[22] Filed: Oct. 10, 1986

[30] Foreign Application Priority Data

Oct. 16, 1985 [DE] Fed. Rep. of Germany ..... 3536852

[51] Int. Cl.[4] ..... F21L 19/02

[52] U.S. Cl. ..... 362/161; 362/266; 431/298

[58] Field of Search ..... 431/298, 320, 324; 362/161, 162, 266

[56] References Cited

U.S. PATENT DOCUMENTS

| | | | |
|---|---|---|---|
| 154,442 | 8/1874 | Barbarin | 362/162 |
| 591,108 | 10/1897 | Betts | 431/320 |
| 1,091,248 | 3/1914 | Sarkadi | 362/161 |
| 1,988,703 | 1/1935 | Root | 362/161 |
| 1,991,773 | 2/1935 | Sauer | 431/324 |
| 2,121,903 | 6/1938 | Currie | 431/324 |
| 2,121,904 | 6/1938 | Currie | 431/324 |
| 4,186,430 | 1/1980 | Britton | 362/161 |
| 4,446,213 | 2/1987 | Fanelli et al. | 431/298 |
| 4,520,431 | 5/1985 | Fanelli et al. | 362/162 |
| 4,608,011 | 8/1986 | Constock | 431/324 |

FOREIGN PATENT DOCUMENTS

| | | | |
|---|---|---|---|
| 446728 | 7/1912 | France | 431/320 |
| 43386 | 3/1908 | Switzerland | 431/324 |

*Primary Examiner*—Samuel Scott
*Assistant Examiner*—H. A. Odar
*Attorney, Agent, or Firm*—Collard, Roe & Galgano

[57] ABSTRACT

There is provided a wind lantern including a container for holding a can filled with liquid wax, the can having on its top side a small tube with a wick extending into the can serving as the burner, and a glass globe adapted to be placed on the container. The wind lantern further includes a detachable base disposed on the bottom end of the container, the base having an outer step extending therearound and a center core provided with a center bore, so that for transport of the wind lantern, the base can be attached to the top edge of the container between the glass globe and the can filled with liquid wax, so as to seal the can.

3 Claims, 5 Drawing Figures

WIND LANTERN

The present invention relates to a wind lantern consisting of a container designed to hold a can filled with liquid wax, the can having at its top end a small tube with a wick extending into the can which serves as the burner, and a glass globe adapted to be placed on the container.

Different types of wind lanterns are well known. These wind lanterns generally consist of a base and a glass globe designed to be attached to the base, and a candle or tank containing a liquid fuel and a wick inserted in the base. Such prior art wind lanterns are generally provided with all sorts of decorations and used in the home or outdoors, for example on porches or in the garden or the like. However, because of their design, such wind lanterns cannot be readily packed up and carried along for leisure activities, for example on fishing trips.

It is, therefore, an object of the present invention to provide a wind lantern of the type described above which can be used normally as a wind lantern, on the one hand, and easily packed up and transported with the burner without the liquid wax or fuel leaking from the can.

The above object is accomplished according to the present invention by providing a wind lantern of the type described above wherein a detachable base is arranged on the bottom end of the container having an outer step extending around the base and with a center core provided with a central blind bore, so that for transport of the wind lantern, the base can be attached to the top edge of the container between the glass globe and the can containing the liquid wax or fuel, so as to seal the can.

According to a particular embodiment of the wind lantern of the present invention, a cover is placed on the globe of the lantern. For transport of the wind lantern, this cover can be locked by means of a swivel-mounted bail secured on the container, the bail being semicircularly shaped at its lower end.

Furthermore, for fastening the bail and mounting the globe of the lantern, the container may have an upper projecting edge, whereby the base can be attached to this edge by fitting the step thereof, which extends around the base, to such edge. The base is also provided with a recess extending around the bottom side thereof which is adapted to hold the globe of the lantern when inserted in the recess.

A significant advantage is realized with the wind lantern according to the present invention in that for operating the lantern, the base can be attached to the bottom end of the container, and the can with the liquid wax and wick extending into the globe of the lantern, being inserted in the container, can be used as the burner or light source.

When the wind lantern is assembled for transport, the base is placed on the top of the container, sealing the can with liquid wax in the container with its center core, which is provided with a bore. The globe of the lantern with the top cover is subsequently attached to the base by placing it in the stepped recess on the bottom side of the base. In order to lock and keep the parts together, the swivel-mounted bail is swung upwardly, causing it to grip over the cover with its semicircular part so as to force the globe and base against the container.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
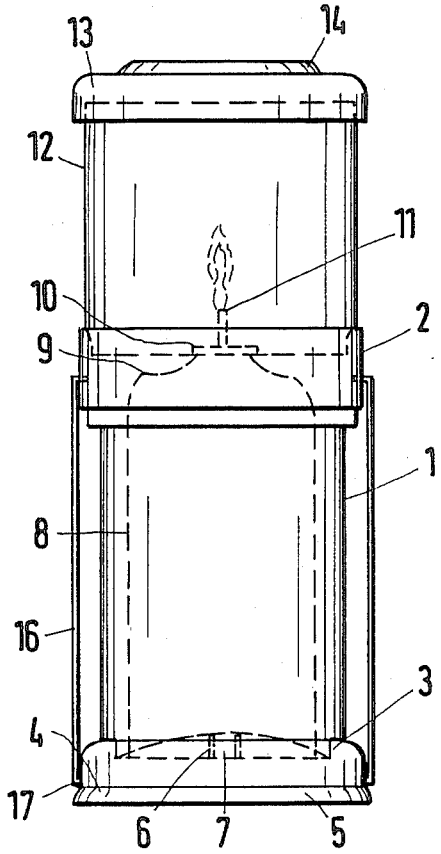
FIG. 1 is a side elevational view of the wind lantern in the operating condition.
Figure 2:
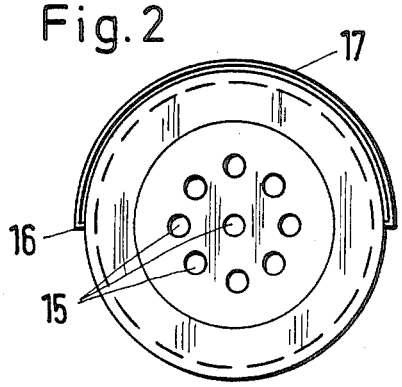
FIG. 2 is a top plan view of the wind lantern of FIG. 1.

Now turning to the drawings, there is shown the wind lantern according to the present invention consisting of a cylindrical container 1, for example a container made of plastic material, which has a widened upper edge 2 at its top end. At its bottom end, container 1 has a recess 3 extending therearound, with a base 5 being placed on recess 3, so as to support the container. Base 5 is provided with a step 4 extending all around. On its inside, base 5 has a core 6 with a central blind bore 7.

A can, designated 8, filled with liquid wax is disposed in container 1. Can 8 has a collar 9 and a center attachment 10 at its top end. Center attachment 10 is provided with a small tube with a wick 11 arranged in the center of the attachment. Wick 11 extends into the interior of can 8 containing the wax filling or other fuel.

Glass globe 12 is placed on container 1 within a step in edge 2 thereof, and a top cover 13 having an elevation 14 is placed on the glass globe. Air holes, designated 15, are provided within elevation 14.

Furthermore, a bail 16, having a semicircular configuration 17 at its bottom side, is pivotally suspended on widened upper edge 2 of container 1.

When the wind lantern is ready for operation as shown in FIG. 1, the wick can be lighted and the gases burn in the form of a soot-free flame.

Figure 3:
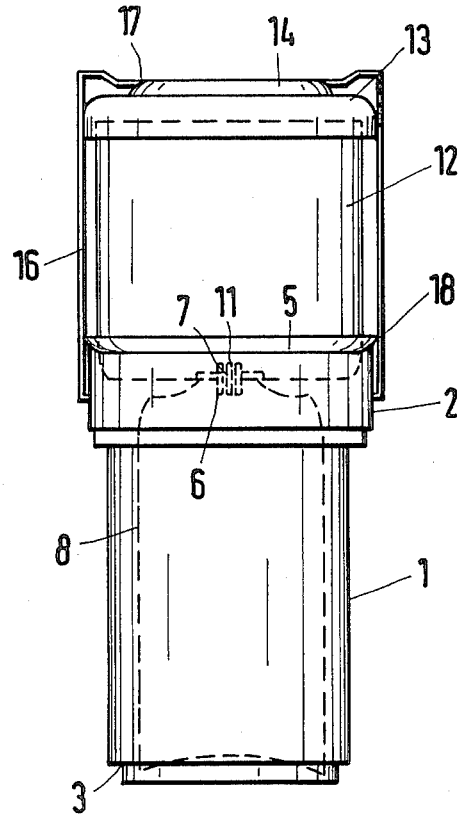
FIG. 3 is a side elevational view of the wind lantern assembled for transport.
Figure 4:
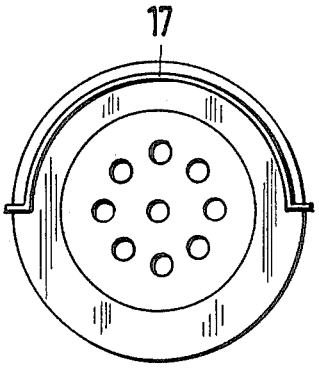
FIG. 4 is a top plan view of the wind lantern as shown in FIG. 3.

When the wind lantern is assembled for transportation purposes, base 5 is first removed from the bottom end as shown in FIG. 3 and reversably attached to upper edge 2 of container 1 by the engagement of step 4 therewith, so that core 6 engages attachment 10 and center bore 7 is placed over wick 11. In this way, can 8 is sealed so that leakage of the liquid wax is prevented. Glass globe 12 is then placed in lower recess 18 of base 5 and bail 16 is swung upwardly, so that it grips over cover 13 with its semicircular part 17 and forces the cover together with the globe against base 5 and thus against container 1. In this way, the assembly is firmly joined or fastened together. The wind lantern so assembled can be transported to any location at any altitude without fear of the liquid wax leaking from can 8.

Figure 5:
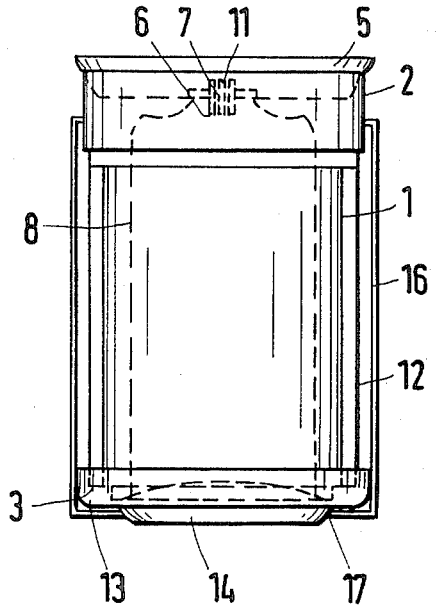
FIG. 5 is a side elevational view of the wind lantern in the assembled state ready for transportation with even less spatial requirements.

In FIG. 5 the wind lantern is shown in the assembled state ready for transportation. In this state, glass globe 12 is pushed on container 1 from the bottom and the parts are maintained together by cover 13, which is attached from the bottom, whereas the lock at the top is assured by base 5. Due to the fact that wick 11 is sealed by means of bore 7 in core 6 of base 5, the wind lantern, of course, can be set up in the reversed way as well. In this state, the wind lantern assembled and ready for transportation requires even less space than the form shown in FIG. 3.

While only a single embodiment of the present invention has been shown and described, it will be obvious that many changes and modifications may be made thereunto without departing from the spirit and scope of the invention.

What is claimed is:

1. In a wind lantern consisting of a container having a bottom end, a can held by said container and filled with liquid wax having at its upper end a small tube with a wick extending into the can serving as the burner, and a glas globe adapted to be placed on the container, the improvement comprising:

a detachable base disposed on the bottom end of the container, said base having an outer step extending around the base and a center core provided with a center bore, so that for transport of the wind lantern, the base may be placed on the top edge of the container between the glass globe and the can filled with liquid wax, so as to seal the can.

2. The wind lantern according to claim 1, which further comprises a cover mounted on the glass globe, said cover being lockable for the transport of the lantern by a swivel-mounted bail secured on the container, said bail having a semicircular shape.

3. The wind lantern according to claim 2, wherein said container has a top edge adapted for securing said bail and for attaching thereto the base by the engagement of said outer step of said base with said top edge, the center bore in the center core of the base being adapted to be placed over the wick, and said base further being provided on its bottom side with a recess adapted to hold the glass globe.

* * * * *